US010300348B2

(12) United States Patent
Morris

(10) Patent No.: US 10,300,348 B2
(45) Date of Patent: May 28, 2019

(54) BALL PICKUP AID PUTTER

(71) Applicant: KARSTEN MANUFACTURING CORPORATION, Phoenix, AZ (US)

(72) Inventor: Thomas J. Morris, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/602,470

(22) Filed: May 23, 2017

(65) Prior Publication Data

US 2017/0340926 A1 Nov. 30, 2017

Related U.S. Application Data

(60) Provisional application No. 62/342,776, filed on May 27, 2016.

(51) Int. Cl.
*A63B 47/02* (2006.01)
*A63B 53/04* (2015.01)

(52) U.S. Cl.
CPC ..... *A63B 47/02* (2013.01); *A63B 53/0487* (2013.01); *A63B 53/04* (2013.01); *A63B 2053/0408* (2013.01); *A63B 2053/0441* (2013.01)

(58) Field of Classification Search
CPC ..... A63B 47/02; A63B 53/0487; A63B 53/04; A63B 2053/0408; A63B 2053/0441
See application file for complete search history.

(56) References Cited

U.S. PATENT DOCUMENTS 3,632,112 A * 1/1972 Jacobs ..... A63B 47/02 294/19.2
3,949,894 A * 4/1976 Underwood ..... B32B 25/10 220/560.02
4,580,784 A * 4/1986 Brill ..... A63B 47/02 473/286
4,962,927 A * 10/1990 Colucci ..... A63B 53/0487 294/19.2

(Continued)

FOREIGN PATENT DOCUMENTS

CN 2461602 11/2001
JP 2005160691 6/2005

(Continued)

OTHER PUBLICATIONS

Community Review—Taylormade Spider Si Putter, May 28, 2014 ,http://www.mygolfspy.com/community-review-taylormade-spider-si-putter/.

(Continued)

*Primary Examiner* — Stephen L Blau

(57) ABSTRACT

Various embodiments of a golf putter having a putter head attached to an elongated shaft with the putter head defining a retention cavity configured to engage and retain a golf ball therein are disclosed. The retention cavity is formed along the back region of the putter head and is configured to have a diameter that is slightly less than the diameter of a regulation sized golf ball such that the golf ball is retained therein when urged into the confines of the retention cavity by the putter head. The putter head further includes an alignment aid that cooperates with the retention cavity to assist in aligning the golf putter during a putting stroke.

12 Claims, 12 Drawing Sheets

(56) References Cited

U.S. PATENT DOCUMENTS

| | | | | | |
|---|---|---|---|---|---|
| 5,102,139 | A * | 4/1992 | Greig | A63B 47/02 | 473/286 |
| 5,137,275 | A * | 8/1992 | Nelson | A63B 53/02 | 473/306 |
| 5,368,352 | A * | 11/1994 | Juhas | A63B 47/02 | 294/19.2 |
| 5,692,968 | A * | 12/1997 | Shine | A63B 47/02 | 294/19.2 |
| 6,322,457 | B1 * | 11/2001 | Klein | A63B 47/02 | 294/19.2 |
| 6,878,071 | B1 | 4/2005 | Schwieger | | |
| 7,059,971 | B1 * | 6/2006 | Schmitt | A63B 47/02 | 473/285 |
| D573,673 | S * | 7/2008 | Noyes | D21/721 | |
| 7,846,036 | B2 * | 12/2010 | Tanaka | A63B 47/02 | 473/286 |
| 8,109,838 | B2 * | 2/2012 | Solheim | A63B 47/02 | 473/249 |
| D768,248 | S * | 10/2016 | Rollinson | D21/744 | |
| D771,208 | S * | 11/2016 | Bettinardi | D21/744 | |
| D773,573 | S * | 12/2016 | Abbott | D21/744 | |
| D776,771 | S * | 1/2017 | Peterson | D21/744 | |
| 2003/0064820 | A1 * | 4/2003 | Middleton | A63B 53/0487 | 473/226 |
| 2004/0147334 | A1 * | 7/2004 | D'Agguano | A63B 47/02 | 473/286 |
| 2008/0248894 | A1 | 10/2008 | Henry | | |
| 2009/0170622 | A1 | 7/2009 | Hilton | | |
| 2009/0170629 | A1 * | 7/2009 | Hilton | A63B 53/0487 | 473/334 |
| 2009/0275420 | A1 | 11/2009 | Tanaka | | |
| 2009/0305807 | A1 | 12/2009 | Solheim | | |
| 2010/0009781 | A1 | 1/2010 | Vanderbilt | | |
| 2012/0083353 | A1 | 4/2012 | Franklin | | |
| 2013/0237338 | A1 | 3/2013 | Pak | | |

FOREIGN PATENT DOCUMENTS

| | | |
|---|---|---|
| JP | 2007307334 | 11/2007 |
| JP | 2011255135 | 12/2011 |
| JP | 2012029858 | 2/2012 |

OTHER PUBLICATIONS

The View From Putterzone.com, Oct. 5, 2010 ,http://www.putterzone.com/2010/10/ping-scottsdale-putter-review.html.

* cited by examiner

BALL PICKUP AID PUTTER

CROSS REFERENCE TO RELATED APPLICATIONS

This claims the benefit of U.S. Provisional Patent Application No. 62/342,776, filed on May 27, 2016, the contents of all of which are incorporated fully herein by reference.

FIELD

Aspects of the present disclosure generally relate to golf equipment, and in particular to golf putters and methods for manufacturing golf putter heads having a retention cavity for retrieval of a golf ball.

BACKGROUND

A conventional golf putter typically includes a shaft attached to a putter head configured for putting a golf ball resting on a putting surface with the goal of putting the golf ball into a hole of a green. After the golfer has completed putting the golf ball, strenuous physical activity by the golfer may be required to retrieve the golf ball from either the hole or the putting surface. As such, the golfer may have to continuously bend over and/or kneel down to retrieve the golf ball over the course of a round which can lead to muscle strain or possible injury, especially in elderly golfers or golfers with back or other health issues. In addition, such continuous strenuous physical activity of retrieving the golf ball in such a manner can also eventually lead to strain on the back muscles and knee joints of the golfer, which over time, can stiffen and further injure the player as well as cause the player to exhibit non-optimal form, slower swing speeds, and/or incorrect golf swing.

It is with these observations in mind, among others, that various aspects of the present disclosure related to a golf putter with a ball retention cavity for retrieving a golf ball were conceived and developed.

BRIEF DESCRIPTION OF THE DRAWINGS

Corresponding reference characters indicate corresponding elements among the view of the drawings. The headings used in the figures do not limit the scope of the claims.

Corresponding reference characters indicate corresponding elements among the view of the drawings. The headings used in the figures should not be interpreted to limit the scope of the claims.

DETAILED DESCRIPTION

Aspects of the present disclosure relate to a putter having a putter head defining a retention cavity for aiding with golf ball retrieval and acts as an alignment aid for assisting an individual to visually align the golf putter with a golf ball during a putting stroke. In some embodiments, the retention cavity may be formed along the back portion of the putter head and be configured to engage and retain a golf ball therein. In one embodiment, the retention cavity may be defined along the back portion of the putter head equidistant from the toe and the heel of the putter. When the golf ball rests on a putting surface or disposed within a hole of a golf green, the retention cavity of the putter head may be urged into engagement with the golf ball to retain the golf ball within the confines of the retention cavity. The retention cavity diminishes the need for an individual to bend over and/or kneel down to pick up a golf ball from a putting surface, which reduces the stress and strain experienced by the back and knees of the individual in performing retrieval of the golf ball.

In some embodiments the putter head may further include an alignment aid defined on the crown of the putter head in a manner that cooperates with the retention cavity to align a golf ball during a putting stroke. In some embodiments, the alignment aid may have a partial octagonal design having three sides, although in other embodiments differently configured visual aids are contemplated, such as visual aids having a single or multiple arrow configurations, single line or multiple parallel line configurations, or other types of configurations. In some embodiments, the second side of the alignment aid may be parallel with the strike face of the putter head and parallel with a front side of the retention cavity such that the alignment aid and retention cavity collectively assist the individual in aligning the putter head relative to the golf ball during a putting stroke. In some embodiments, the alignment aid may be positioned equidistant from the toe and the heel of the putter head, thus aligning the alignment aid with the shape of the retention cavity.

The disclosed putter head facilitates the retrieval of golf balls by pressing the putter head onto the golf ball resting on a putting surface to engage and then retain the golf ball within the retention cavity of the putter head. Various embodiments of the retention cavity are configured to "pinch" the golf ball within the confines of the retention cavity and secure it therein as the putter head presses against the golf ball that may lie either in a hole of a green or rests on a putting surface.

Figure 1:
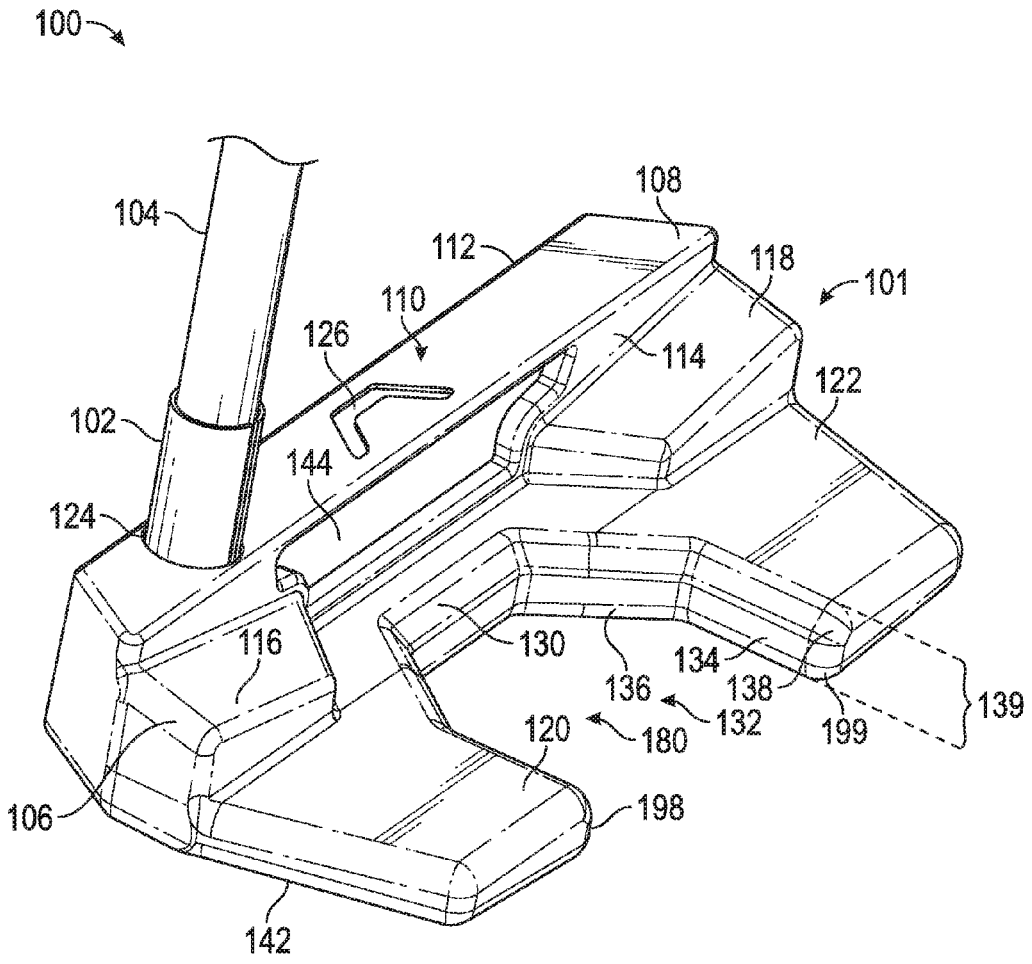
FIG. 1 is a perspective view of a golf putter having a putter head, according to aspects of the present disclosure.

As disclosed herein, various embodiments of a golf putter, designated 100, are described and illustrated in FIGS. 1-16. Referring to FIG. 1, one embodiment of the golf putter 100 includes a putter head 101 having a hosel 102 coupled to an elongated shaft 104 configured for gripping by an individual when performing a putting stroke. As shown, the putter head 101 includes a putter body 110 defining a heel region 106, a toe region 108 formed opposite the heel region 106, a strike face 112, a back region 114 formed opposite the strike face 112, a sole region 142 (or bottom region), and a crown region 140 (top region) formed opposite the sole region 142.

Figure 2:
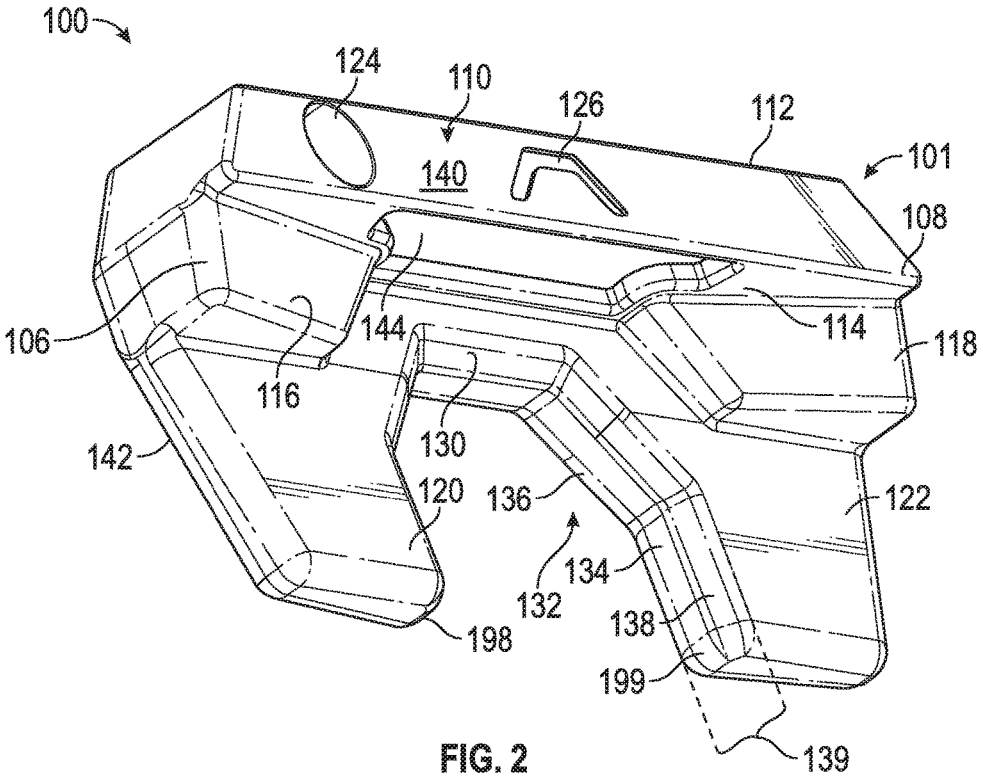
FIG. 2 is a perspective view of the putter head with a ball retention cavity, according to aspects of the present disclosure.
Figure 3:
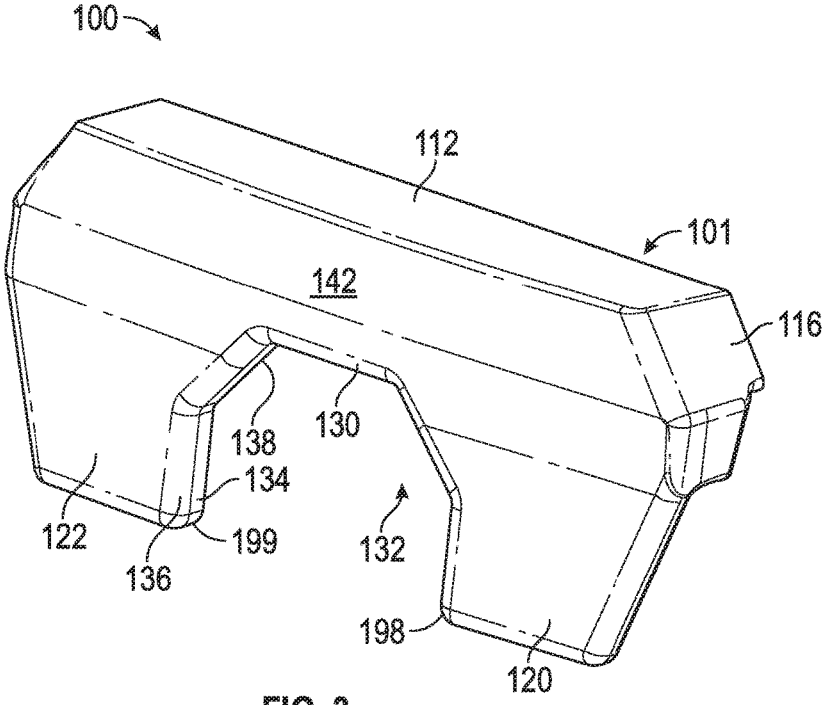
FIG. 3 is a bottom perspective view of the putter head, according to aspects of the present disclosure.

As shown in FIG. 2, in some embodiments the putter body 110 defines a first shoulder 116 and a second shoulder 118 formed on opposing lateral sides of back region 114 of the putter head 101. In many embodiments, the putter body 110 further includes an interior perimeter 130 defined inwardly along the back region 114 of the putter head 101 equidistant the heel region 106 and toe region 108 of the putter head 101 that collectively form a retention cavity 132 configured for engaging and temporarily retaining a golf ball 360 therein. The retention cavity 132 defines a predetermined area of three-dimensional space formed within the interior perimeter 130 of the putter head 101 having one or more contact areas sufficient to engage and retain the golf ball 360 within the retention cavity 132.

As further shown, in some embodiments the retention cavity 132 is collectively defined by a first arm 120 and a second arm 122 disposed on opposing lateral sides of retention cavity 132. In some embodiments, the first arm 120 is formed adjacent a first shoulder 116 and a second arm 122 is formed adjacent the second shoulder 118. In some embodiments, the putter head 101 may include an aperture 124 for the hosel 102 which is configured to receive and engage the elongated shaft 104 therein as shown in FIG. 1. In some embodiments, a recess or cavity 144 may be formed along the back region 114 below the alignment aid 126.

Figure 4:
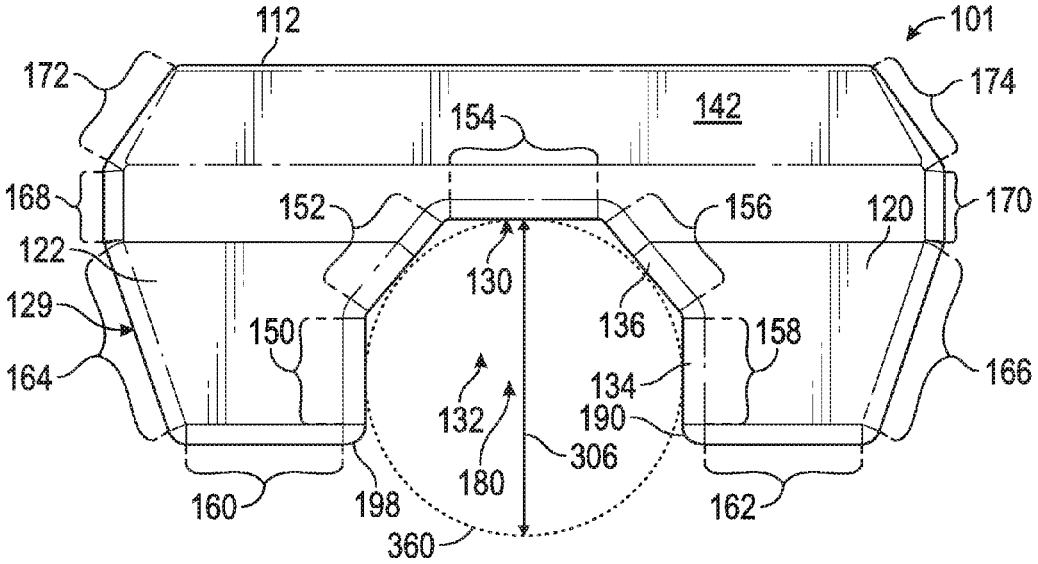
FIG. 4 is a bottom plan view of the putter head, according to aspects of the present disclosure.
Figure 5:
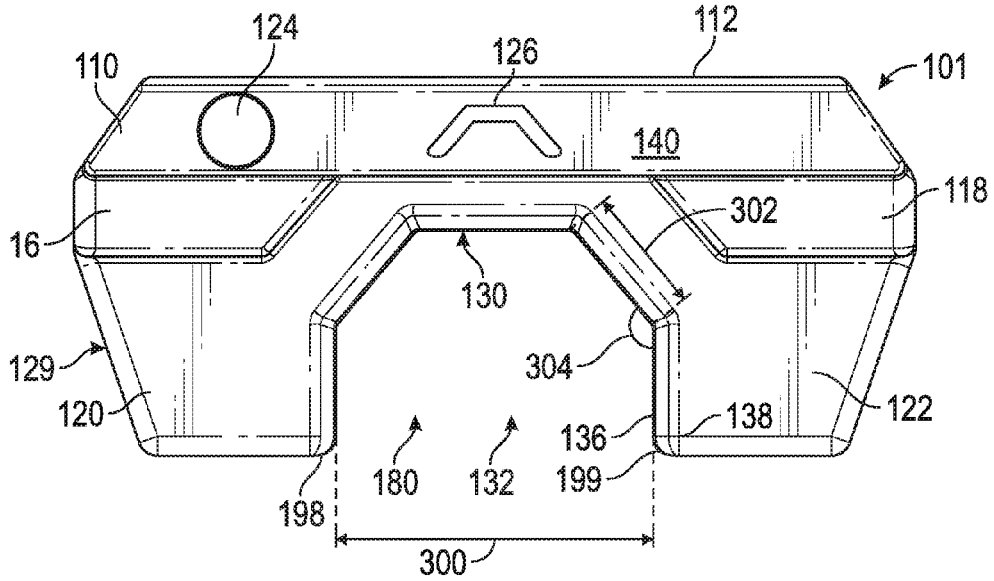
FIG. 5 is a top plan view the putter head, according to aspects of the present disclosure.

In one embodiment shown in FIGS. 1-5, the retention cavity 132 defines a five-sided slot forming a lateral opening 180 defined between end points 198 and 199 of the interior perimeter 130 which is configured to allow a portion of the golf ball 360 to extend outwardly from the retention cavity 132 as shown in FIG. 4. As shown in FIG. 2-6, in some embodiments the interior perimeter 130 of the retention cavity 132 defines a bottom edge 136, a top edge 138, and a peripheral surface 134 formed between the bottom edge 136 and the top edge 138. The peripheral surface 134 extends inwardly toward the geographic center of the retention cavity 132 such that the bottom edge 136 and top edge 138 extend away from the peripheral surface 134. In some embodiments, the peripheral surface 134 is configured to define one or more contact portions for engaging and retaining the golf ball 360 when the golf ball 360 is engaged within the retention cavity 132.

As illustrated in FIGS. 11A-11C and 14-16, the peripheral surface 134, the bottom edge 136, and/or the top edge 138 which collectively form the interior perimeter 130 may define different configurations for engaging and retaining the golf ball 360 within the interior of the retention cavity 132. The peripheral surface 134, bottom edge 136, and top edge 138 may collectively define an interior surface region 139 around the periphery of the retention cavity 132 which provides a surface area for contacting and retaining the golf ball 360. In a first embodiment shown in FIGS. 11A and 14, the bottom edge 136 and the top edge 138 of the interior perimeter 130 define a rounded configuration and the peripheral surface 134 defines a substantially flat configuration. In a second embodiment shown in FIGS. 11B and 15, the bottom edge 136 and the top edge 138 of the interior perimeter 130 both define an angular configuration that gradually tapers away from the peripheral surface 134. In a second embodiment shown in FIGS. 11C and 16, the bottom edge 136, the top edge 138 and peripheral surface 134 may collectively define a rounded configuration with no flat surfaces. Alternative embodiments of the interior surface region 139 are contemplated including a retention cavity 132 where the interior surface region 139 defining a single, generally rounded surface, or any combination of angular flat and/or rounded surfaces. In many embodiments, the top and bottom edges 136 and 138 of the interior surface region 139 may be configured such that a thickness of the sole region 142 surrounding the retention cavity 132 (along the peripheral surface 134) is reduced. A reduction in thickness of the sole region 142 surrounding the retention cavity 132 at the peripheral surface 134, by nature of the angular bottom edge 136 and the top edge 138, respectively, causes the golf ball 360 to slide partially into the retention cavity 132 and engage the peripheral surface 134. In some embodiments, the bottom edge 136 may be rounded with a radius of 0.07 inches and the top edge 138 may be rounded with a radius of 0.1 inches.

FIGS. 4-5, 8 and 9 illustrate further details regarding structural aspects of the putter head 101 and the retention cavity 132. FIG. 4 shows one embodiment of the putter head 101 viewed from the sole region 142. One embodiment of the putter body 110 may have a peripheral edge having an exterior perimeter 129 in communication with the interior perimeter 130 that defines the retention cavity 132. As shown, the exterior perimeter 129 of the putter head 101 may define a first exterior side 160 defined by second arm 122, a second exterior side 162 defined by first arm 120, a third exterior side 164 formed adjacent to the first exterior side 160, a fourth exterior side 166 formed adjacent to second exterior side 162, a fifth exterior side 168 formed adjacent to the third exterior side 164, a sixth exterior side 170 formed adjacent to fourth exterior side 166, and a seventh exterior side 172 and an eighth exterior side 174 formed on opposite respective sides adjacent the strike face 112. Although some embodiments of the putter body 110 may have the aforementioned exterior sides 160, 162, 164, 166, 168, 170, and 172, other embodiments of the putter body 110 may have a different number of exterior sides.

As further shown in FIG. 4, some embodiments the interior perimeter 130 that forms the retention cavity 132 may be collectively defined by a plurality of interior sides formed between opposing end points 198 and 199 that define lateral opening 180 of the retention cavity 132. As shown, one embodiment of the interior perimeter 130 may include a first interior side 150 formed adjacent end point 198, a second interior side 152 formed adjacent the first interior side 150, a third interior side 154 formed adjacent the second interior side 152, a fourth interior side 156 formed adjacent the third interior side 154 and a fifth interior side 158 formed between the fourth interior side 156 and end point 199. In one embodiment, the first interior side 150, second interior side 152, third interior side 154, fourth interior side 156, and fifth interior side 158 may define a same length 302 of approximately 0.65 inches.

In another embodiment, the first interior side 150 and fifth interior side 158 can have a length between 0.30 inches to 1.35 inches. The length of the first interior side 150 and fifth interior side 158 can be 0.30 inches, 0.35 inches, 0.40 inches, 0.45 inches, 0.50 inches, 0.55 inches, 0.60 inches, 0.65 inches, 0.70 inches, 0.75 inches, 0.80 inches, 0.85 inches, 0.90 inches, 0.95 inches, 1.0 inches, 1.05 inches, 1.10 inches, 1.15 inches, 1.20 inches, 1.25 inches, or 1.30 inches. The length of the first interior side 150 and the fifth interior side 158 can be 0.65 inches.

The second interior side 152 and fourth interior side 156 can have a length between 0.45 inches and 0.80 inches. The length of the second interior side 152 and the fourth interior side 156 can have a length of 0.45 inches, 0.46 inches, 0.47 inches, 0.48 inches, 0.49 inches, 0.50 inches, 0.51 inches, 0.52 inches, 0.53 inches, 0.54 inches, 0.55 inches, 0.56 inches, 0.57 inches, 0.58 inches, 0.59 inches, 0.60 inches, 0.61 inches, 0.62 inches, 0.63 inches, 0.64 inches, 0.65 inches, 0.66 inches, 0.67 inches, 0.68 inches, 0.69 inches, 0.70 inches, 0.71 inches, 0.72 inches, 0.73 inches, 0.74 inches, 0.75 inches, 0.76 inches, 0.77 inches, 0.78 inches, 0.79 inches, or 0.80 inches. The second interior side 152 and the fourth interior side 156 can have a length of 0.62 inches.

The third interior side 154 can be a length of approximately 0.80 inches. The length of the third interior side 154 can be a length of 0.75 inches, 0.76 inches, 0.77 inches, 0.78 inches, 0.79 inches, 0.80 inches, 0.81 inches, 0.82 inches, 0.83 inches, 0.84 inches, or 0.85 inches. The third interior side 154 can be a length of 0.65 inches.

In one embodiment, the first interior side 150, second interior side 152, third interior side 154, fourth interior side 156, and fifth interior side 158 may define an angle 304 of approximately 130 degrees between each of the respective interior sides 150, 152, 154, 156, and 158. In other embodiments, the first interior side 150, second interior side 152, third interior side 154, fourth interior side 156, and fifth interior side 158 may define an angle 304 of approximately 110, 112, 114, 116, 118, 120, 122, 124, 126, 128, 130, 132, 134, 136, 138, 140, 142, 144, 146, 148, or 150 degrees between each of the respective interior sides 150, 152, 154, 156, and 158. In other embodiments, the first interior side 150, second interior side 152, third interior side 154, fourth interior side 156, and fifth interior side 158 may define an angle 304 of approximately 120 degrees between each of the adjacent interior sides 150, 152, 154, 156, and 158. In other embodiments, the first interior side 150, second interior side 152, third interior side 154, fourth interior side 156, and fifth interior side 158 may define an angle 304 of approximately 100, 102, 104, 106, 108, 110, 112, 114, 116, 118, 120, 122, 124, 126, 128, 130, 132, 134, 136, 138, or 140 degrees between each of the adjacent interior sides 150, 152, 154, 156, and 158. In some embodiments, the first, second, third, fourth, and fifth interior sides 150, 152, 154, 156 and 158 may define the same lengths or different lengths relative to each other. The methods, apparatus, and articles of manufacture are not limited in this regard.

In some embodiments, the interior perimeter 130 of the retention cavity 132 may define a diameter 300 (FIG. 5) as measured between the first interior side 150 and the fifth interior side 158 of approximately 1.6 inches. In some embodiments, the diameter 300 of the interior perimeter 130 may be 1.45 inches to 1.75 inches for different sized golf balls. The diameter 300 of the interior perimeter 130 may be 1.60 inches for the diameter of a golf ball. In alternate embodiments, length 302 may be in a range of between 0.30 to 1 inches. In some embodiments, the golf ball 360 may have a diameter 306 of about 1.68 inches (consistent with United States Golf Association standards), which is slightly larger than diameter 300 of the retention cavity 132. The methods, apparatus, and articles of manufacture are not limited in this regard.

Figure 6:
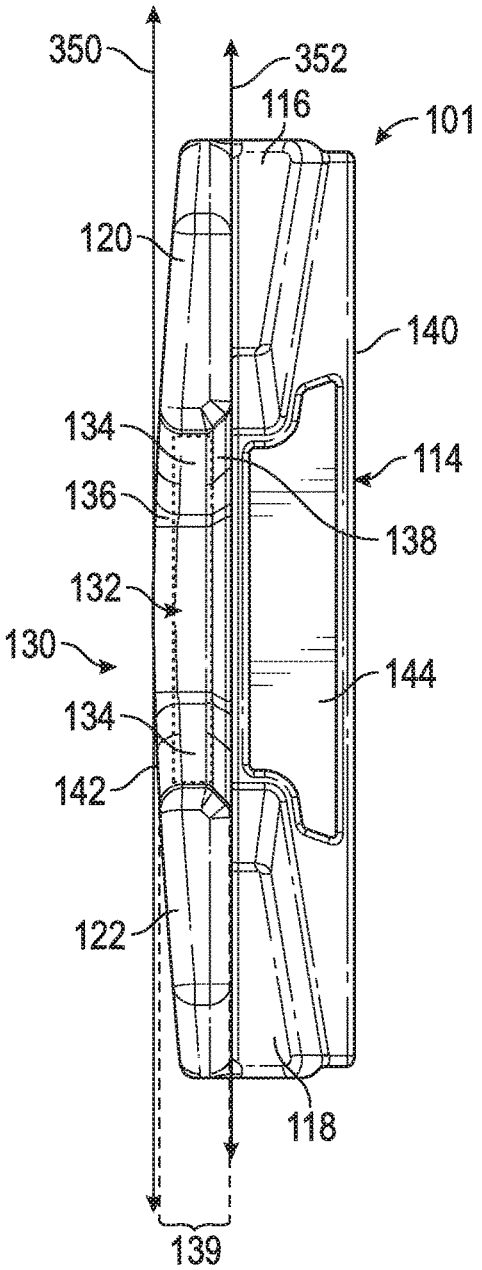
FIG. 6 is a rear view of the putter head, according to aspects of the present disclosure.
Figure 7:
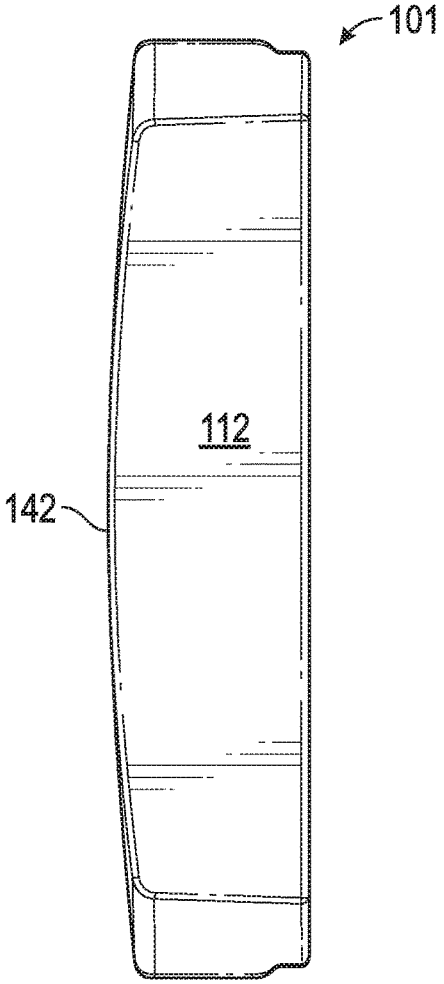
FIG. 7 is a front view the putter head, according to aspects of the present disclosure.
Figure 8:
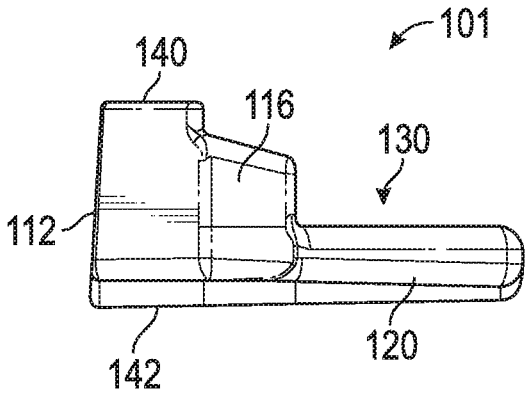
FIG. 8 is a side view of the putter head, according to aspects of the present disclosure.
Figure 9:
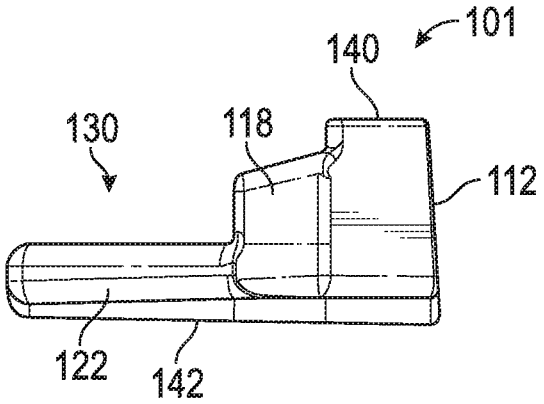
FIG. 9 is an opposite side view of the putter head, according to aspects of the present disclosure.

FIGS. 6-7 illustrate back and front views of one embodiment of the putter head 101. FIG. 6 illustrates the configuration of the back region 114 of putter head 101. As shown, first arm 120, second arm 122, and interior perimeter 130 collectively define part of sole region 142 and may all be formed substantially along a common first horizontal plane 350. In some embodiments, first shoulder 116, recess 144, and second shoulder 118, are substantially disposed along a second horizontal plane 352 above the first horizontal plane 350. In some embodiments the cavity 144 includes a length that extends from the second horizontal plane 352 to crown region 140. As further shown in FIG. 6 and also in FIG. 2, the putter head 101 forms a thinned portion defined by interior perimeter 130, first arm 120, and the second arm 122. In other words, a thickness of a portion of the putter head 101, defined by the first arm 120, second arm 122 and the interior perimeter 130 is substantially less than a thickness of the remaining portion of the putter head 101 defined by the first shoulder 116, the second shoulder 118, and the crown region 140. The methods, apparatus, and articles of manufacture are not limited in this regard.

Figure 10A:
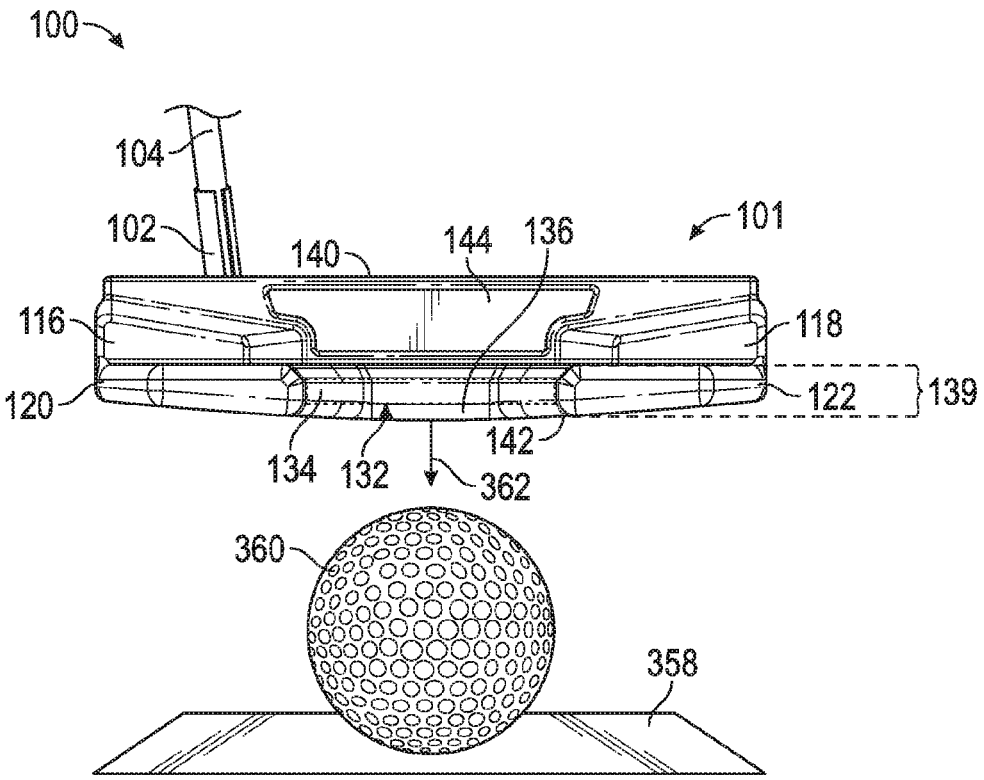
FIGS. 10A-10C are rear views of the putter head showing one sequence for retaining a golf ball within the retention cavity of the putter head, according to aspects of the present disclosure.
Figure 10B:
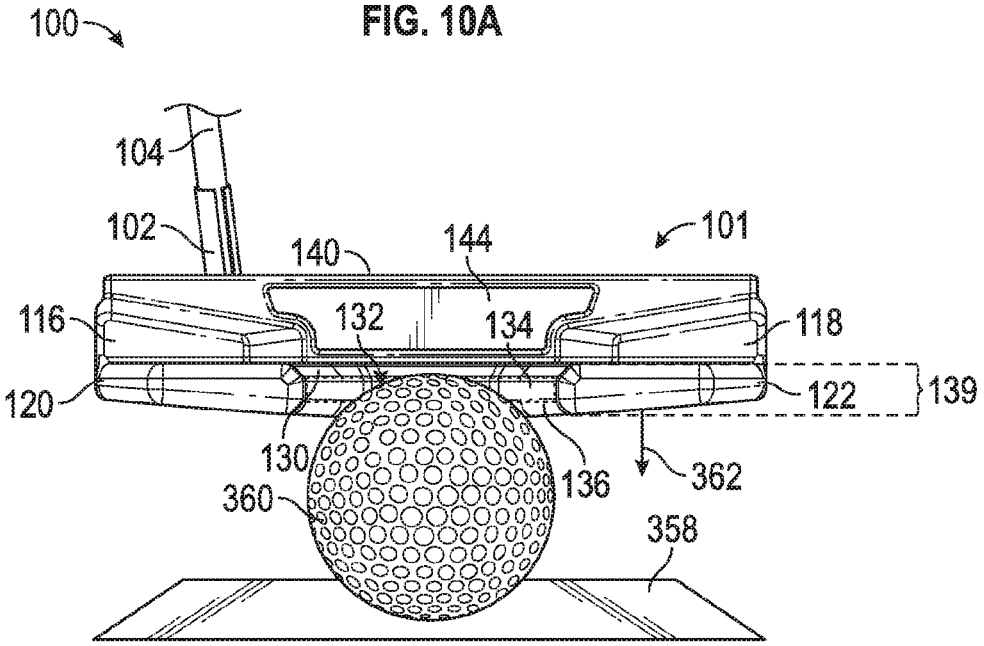
Figure 10C:
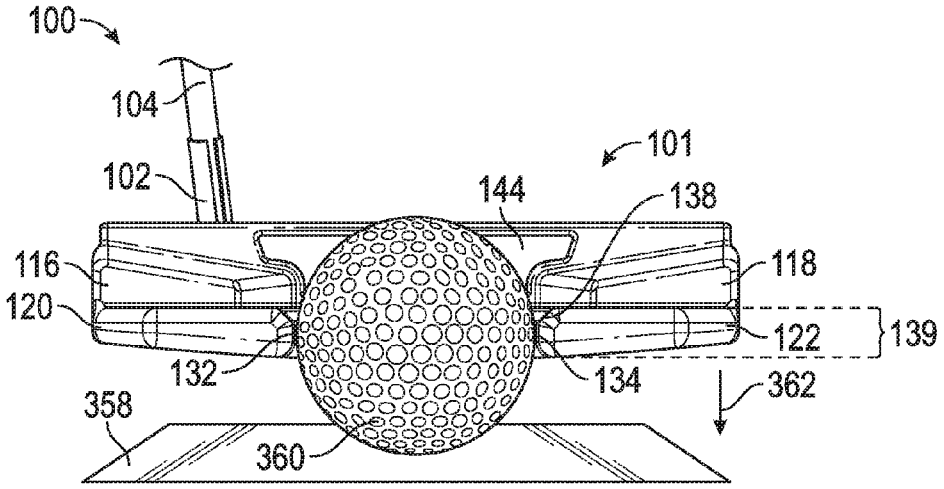
Figure 11A:
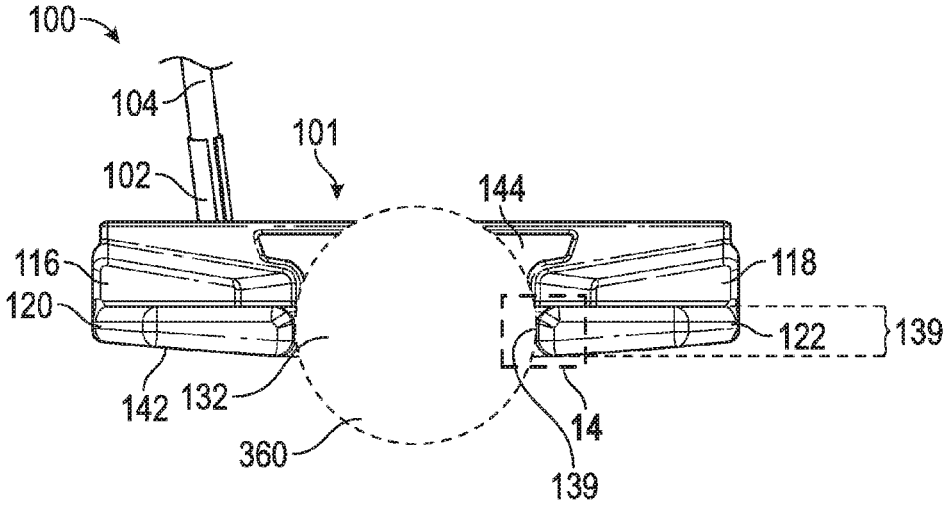
FIGS. 11A-11C are rear views of putter heads showing different configurations of the interior surface region that define the retention cavity, according to aspects of the present disclosure.
Figure 11B:
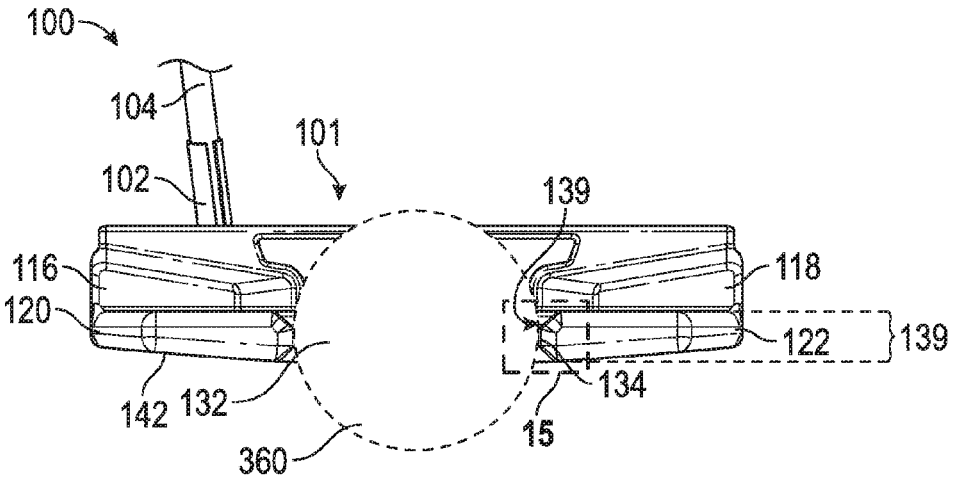
Figure 11C:
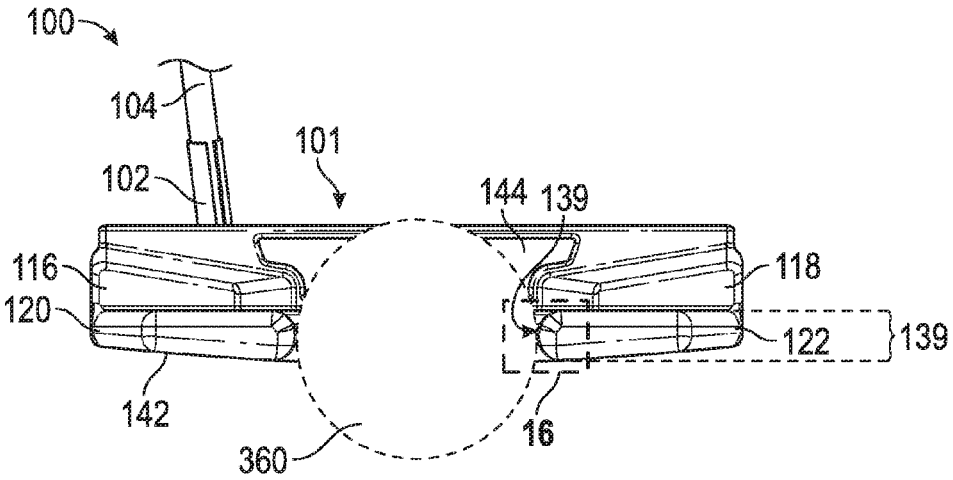

FIGS. 10A-10C shows one method for engaging and retaining a golf ball 360 using the putter head 101 having the retention cavity 132. As shown in FIG. 10A, the putter head 101 may be initially positioned over a golf ball 360 resting on a putting surface 358 with the sole region 142 of the putter head 101 substantially oriented towards the golf ball 360. As shown, the retention cavity 132 may be aligned directly over the footprint of the golf ball 360. Once so oriented, the putter head 101 may be urged towards the golf ball 360 in a direction 362 to eventually engage the golf ball 360 within the retention cavity 132.

Referring to FIG. 10B, the putter head 101 is brought into contact with the golf ball 360 as the putter head 101 is moved towards the golf ball 360 in the direction 362 sufficient to position the golf ball 360 partially within the retention cavity 132. In particular, the golf ball 360 may be positioned to contact the bottom edge 136 and the peripheral surface 134 such that a top portion of the golf ball 360 is at least partially surrounded and in contact with the bottom edge 136 of the interior perimeter 130. The first, second, third, fourth, and/or fifth interior sides 150, 152, 154, 156, and 158 may be used as guides by the individual to properly align the retention cavity 132 over the golf ball 360. In some embodiments, the rounded edges of the interior surface region 139 allow the golf ball 360 to slide within the retention cavity 132 because the diameter 302 of the interior perimeter 130 is slightly less than the diameter 306 of the golf ball 360, thereby causing a slight compression of the golf ball 360 between the surrounding peripheral surface 134 of the interior perimeter 130 as the golf ball 360 is urged into the retention cavity 132.

Referring to FIG. 10C, once the golf ball 360 is initially engaged to the retention cavity 132 as illustrated in FIG. 10B, the golf ball 360 may be fully seated and engaged within the retention cavity 132 by applying a slight degree of force to the putter head 101 against the golf ball 360 in the direction 362. Applying this force to the putter head 101 against the golf ball 360 urges the golf ball 360 fully within the retention cavity 132 as the golf ball 360 rides over the bottom edge 136 and contacts at least a portion of the peripheral surface 134 which causes a slight compression of the golf ball 360 against the peripheral surface 134 of the retention cavity 132. Because the diameter 300 of the retention cavity 132 is slightly less than the diameter 306 of the golf ball 360, the golf ball 360 will compress sufficiently to become wedged within the retention cavity 132 as the putter head 101 is forced down upon the golf ball 360. This engagement between the exterior surface of the golf ball 360 and the peripheral surface 134 of the retention cavity 132 may apply whether the golf ball 360 is fully engaged within the retention cavity 132 as described or partially engaged within the retention cavity 132. As such, the golf ball 360 may be retained to the putter head 101 to prevent the golf ball 360 from being inadvertently dislodged or disengaged from the retention cavity 132 when the putter head 101 is moved away from the putting surface 358, e.g., lifted in the air away from putting surface 358, thereby allowing the individual to disengage and retrieve the golf ball 360 from the retention cavity 132 by applying a small degree of pressure directly to the golf ball 360.

In some embodiments, at least a portion of the putter head 101 (first arm 120, interior perimeter 130, and second arm 122) at the back region 114 of the putter head 101, particularly at the sole region 142, may be thinner than the other portions of the putter head 101 to facilitate easy engagement and release of the golf ball 360.

Figure 12A:
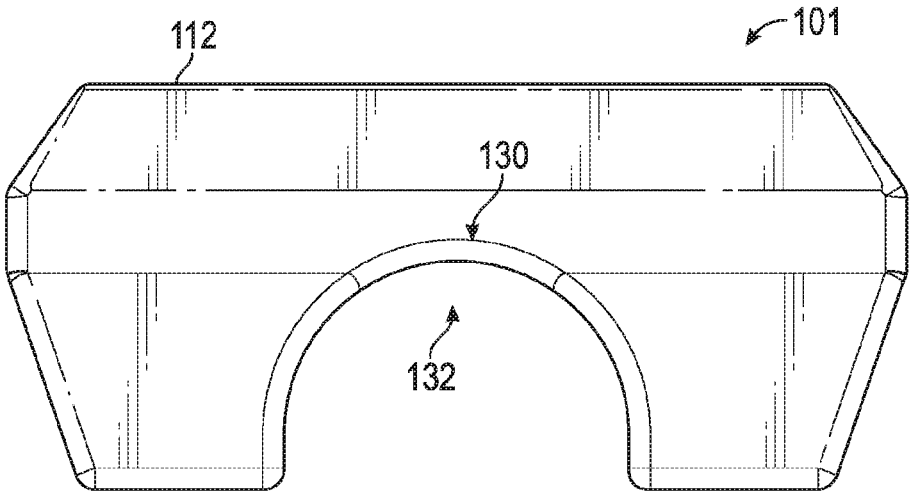
FIGS. 12A-12C are top plan views of putter heads showing different shapes of the retention cavity, according to aspects of the present disclosure.
Figure 12B:
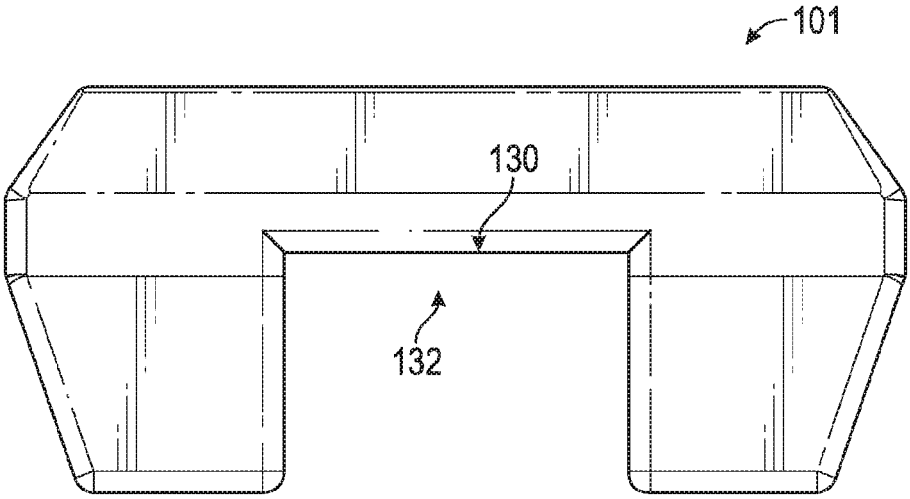
Figure 12C:
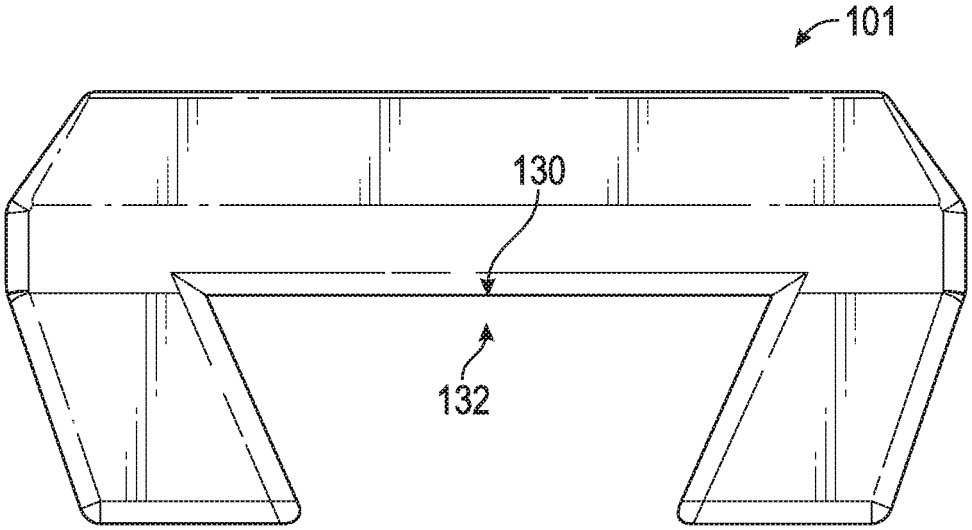

FIGS. 12A-12C show various configurations of the interior perimeter 130 of the retention cavity 132 that may be used to engage and retain a golf ball 360 using the putter head 101. As shown in FIG. 12A, in one embodiment the putter head 101 may define a semi-circular shaped configuration. In another embodiment, the retention cavity 132 may define a square-shaped configuration as shown in FIG. 12B. In yet another embodiment, the retention cavity 132 may define an angular-shaped configuration as shown in FIG. 12C. Alternatively, the retention cavity 132 may be defined by any plurality of sides so long as interior perimeter 130 includes dimensions sufficient to contact and retain the golf ball 360 within the retention cavity 132 as described above. In addition, the interior perimeter 130 may form a rounded configuration, a multi-sided configuration, a circular configuration, a semi-circular configuration, a symmetrical configuration, an asymmetrical configuration, and/or an angular configuration The methods, apparatus, and articles of manufacture are not limited in this regard.

As noted above, in some embodiments the putter head 101 may include an alignment aid 126 formed on the putter body 110 and positioned along the crown region 140 of the putter body 110 and clearly visible to the individual during the putting stroke as the individual grips the shaft 104. In some embodiments, the alignment aid 126 may define an etched or raised ridge portion formed along the crown region 140 of the putter body 110 or printed on the surface of the crown region 140 in which the alignment aid 126 forms various alignment indicator(s) that cooperate with the retention cavity 132 to provide a collective alignment aid for the individual. In some embodiments, the alignment aid 126 may comprise three sides with a second side (middle side) being parallel with respect to the strike face 112 and a third side of the interior perimeter 130 of the retention cavity 132. In some embodiments, the alignment aid 126 may be positioned equidistant the heel region 106 and toe region 108 of the putter body 110, thereby positioning the alignment aid 126 in parallel with retention cavity 132 and a middle portion of the strike face 112. In some embodiments, the alignment aid 126 may define a three-sided angular symbol having a partial octagonal shape defining five sides. The alignment of the retention cavity 132 and the alignment aid 126 collectively function as a visual aid to facilitate a more centered impact of a golf ball against strike face 112 during the putting stroke. The methods, apparatus, and articles of manufacture are not limited in this regard.

Figure 13:
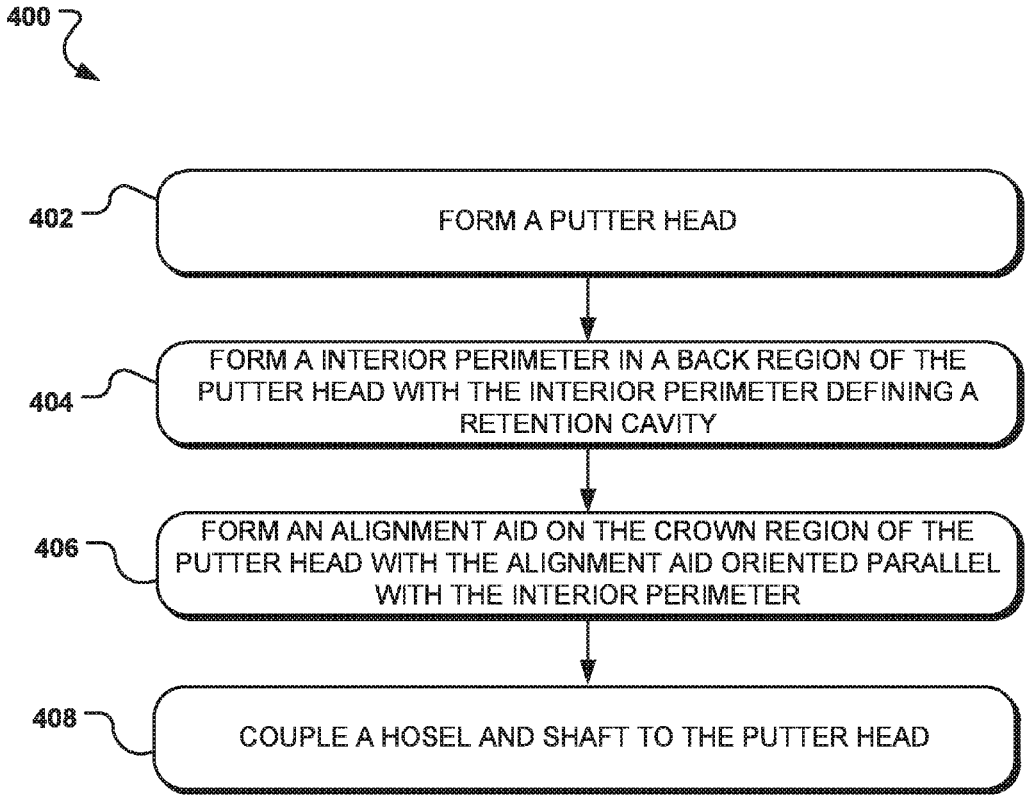
FIG. 13 is a process flow illustrating one method for manufacturing the putter head, according to aspects of the present disclosure.
Figure 14:
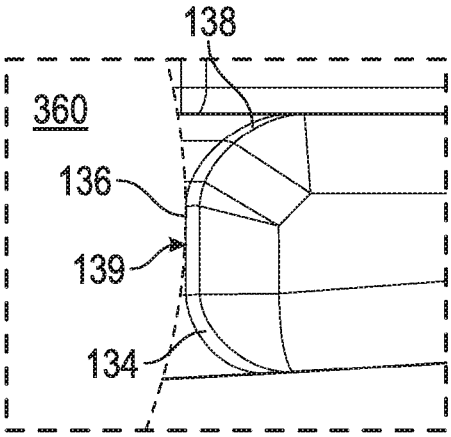
FIG. 14 is an enlarged view of the interior surface region of the retention cavity shown in FIG. 11A, according to aspects of the present disclosure.
Figure 15:
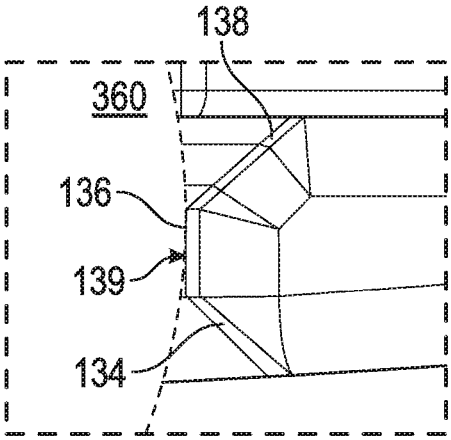
FIG. 15 is an enlarged view of the interior surface region of the retention cavity shown in FIG. 11B, according to aspects of the present disclosure.
Figure 16:
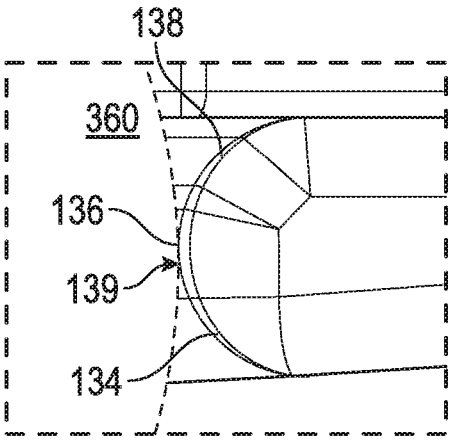
FIG. 16 is an enlarged view of the interior surface region of the retention cavity shown in FIG. 11C, according to aspects of the present disclosure.

FIG. 13 illustrates a process flow 400 showing one method for manufacturing a putter head 101 according to aspects of the present disclosure. At block 402, the putter head 101 is formed having a heel region 106, a toe region 108 formed opposite the heel region 106, a strike face 112, a back region 114 formed opposite the strike face 112, a sole region 142 (or bottom region), and a crown region 140 (top region) formed opposite the sole region 142. The putter head 101 may be formed using metal casting methods, forging methods, or a combination thereof. In many embodiments, the putter head 101 may be manufactured from a steel material, a tungsten material, an aluminum material, a titanium material, composites or other metals, metal alloys, polymers, and the like. The methods, apparatus, and articles of manufacture are not limited in this regard.

At block 404, an interior perimeter 130 defining a retention cavity 132 is formed in the back region 114 of the putter body 110. In some embodiments, the retention cavity 132 may be formed when the putter head is formed at block 402 or cut afterwards using methods know in the art.

At block 406, an alignment aid 126 is formed on the crown region 140 of the putter head 101 with the alignment aid 126 oriented in parallel orientation with the retention cavity 132. In many embodiments, the alignment aid 126 may be disposed between the retention cavity 132 and strike face 112 of the putter body 110 and aligned with the retention cavity 132 equidistant the heel region 106 and toe region 108. The alignment aid 126 may comprise three sides with the second side substantially parallel with the strike face 112. The alignment of the alignment aid 126 and the retention cavity 132 provides a visual aid for a player to facilitate a more centered hit of a golf ball against the strike face 112.

At block 408, the shaft 104 is secured to the putter head 101 at the aperture 124 formed in the putter body 110 using the hosel 102. In some embodiments, the hosel 102 and shaft 104 may be secured to each other and putter head 100 by an adhesive bonding process, such as epoxy, and/or suitable bonding process such as mechanical bonding, soldering, welding, and/or brazing. In some embodiments, the shaft 104 may be screwed onto a receiving portion of the hosel 102. The methods, apparatus, and articles of manufacture are not limited in this regard.

In some embodiments, the retention cavity 132 and/or alignment aid 126 may be implemented with other types of club heads, for example an iron-type club head, a wedge-type club head, a driver-type club head, and a hybrid-type club head.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A golf putter comprising:

an elongated shaft configured for gripping by an individual;

a putter head coupled to the elongated shaft, the putter head defining a heel region, a toe region formed opposite the heel region, a strike face, a back region formed opposite the strike face, a sole region, and a crown region formed opposite the sole region;

an interior perimeter formed along the back region of the putter head, the interior perimeter defining a retention cavity forming a lateral opening between a first end point and a second end point of the interior perimeter, the retention cavity being configured to receive and retain a golf ball within the interior perimeter in a downward direction; and a top edge, a bottom interior edge, and a peripheral surface defined between the top edge and the bottom edge collectively form the interior perimeter of the retention cavity, where the peripheral surface defines a flat configuration, and the top edge and the bottom edge define a rounded configuration;

wherein the interior perimeter defines a plurality of interior sides configured to engage and retain the golf ball; and wherein the plurality of interior sides of the interior perimeter collectively define a five-sided configuration with each interior side having a similar length.

2. The golf putter of claim 1, further comprising:

an alignment aid defined on the crown portion of the putter head and positioned in parallel alignment relative to the retention cavity.

3. The golf putter of claim 1, wherein the interior perimeter defines a first diameter that is slightly less than a second diameter of the golf ball such that the golf ball is retained within the interior perimeter when engaged to the retention cavity.

4. The golf putter of claim 3, wherein the first diameter of the interior perimeter is approximately 1.6 inches.

5. The golf putter of claim 1, wherein the retention cavity is positioned equidistant between the toe region and the heel region of the putter head.

6. The golf putter of claim 1, wherein the back region of the putter head defines a first section comprising a first thickness and a second section comprising a second thickness less than the first thickness with the interior perimeter of the retention cavity formed in the second section of the back region of the putter head.

7. The golf putter of claim 1, further comprising:

a first shoulder defined by the putter head; and a second shoulder formed opposite the first shoulder, wherein the retention cavity is formed between the first and second shoulders of the putter head.

8. The golf putter of claim 1, wherein at least one of the top edge and bottom edge is rounded with a radius of approximately 0.1 inches.

9. A putter head comprising:

a putter body defining a heel region, a toe region formed opposite the heel region, a strike face, a back region formed opposite the strike face, a sole region, and a crown region formed opposite the sole region;

an interior perimeter formed along the back region of the putter head, the interior perimeter defining a retention cavity forming a lateral opening between a first end point and a second end point of the interior perimeter, the retention cavity being configured to receive and retain a golf ball within the interior perimeter in a downward direction; and a top edge, a bottom interior edge, and a peripheral surface defined between the top edge and the bottom edge collectively form the interior perimeter of the retention cavity, where the peripheral surface defines a flat configuration, and the top edge and the bottom edge define a rounded configuration;

wherein the interior perimeter defines a plurality of interior sides configured to engage and retain the golf ball; and wherein the plurality of interior sides of the interior perimeter collectively define a five-sided configuration with each interior side having a similar length.

10. A method of manufacturing a golf putter comprising:

forming an elongated shaft configured for gripping by an individual;

coupling a putter head to the elongated shaft, the putter head defining a heel region, a toe region formed opposite the heel region, a strike face, a back region formed opposite the strike face, a sole region, and a crown region formed opposite the sole region;

forming an interior perimeter along the putter head that defines a retention cavity forming a lateral opening between a first end point and a second end point of the interior perimeter such that the retention cavity is configured to engage and retain a golf ball within the confines of the interior perimeter in a downward direction; and a top edge, a bottom interior edge, and a peripheral surface defined between the top edge and the bottom edge collectively form the interior perimeter of the retention cavity, where the peripheral surface defines a flat configuration, and the top edge and the bottom edge define a rounded configuration;

wherein the interior perimeter defines a plurality of interior sides configured to engage and retain the golf ball; and wherein the plurality of interior sides of the interior perimeter collectively define a five-sided configuration with each interior side having a similar length.

11. The method of claim 10, further comprising:

forming an aperture through the putter head configured to receive a hosel for coupling the elongated shaft to the putter head.

12. The method of claim 10, wherein the forming the interior perimeter further comprises forming the interior perimeter with a rounded configuration, a multi-sided configuration, a circular configuration, a semi-circular configuration, a symmetrical configuration, an asymmetrical configuration, and/or an angular configuration.

* * * * *